US010832600B2

(12) United States Patent
Deng

(10) Patent No.: US 10,832,600 B2
(45) Date of Patent: Nov. 10, 2020

(54) DISPLAY PROP SPLICING DEVICE

(71) Applicant: SHENZHEN FOGUANG LIGHTING CO., LTD, Shenzhen (CN)

(72) Inventor: Qingping Deng, Shenzhen (CN)

(73) Assignee: SHENZHEN FOGUANG LIGHTING CO., LTD., Shenzhen (CN)

( * ) Notice: Subject to any disclaimer, the term of this patent is extended or adjusted under 35 U.S.C. 154(b) by 0 days.

(21) Appl. No.: 16/419,182

(22) Filed: May 22, 2019

(65) Prior Publication Data

US 2020/0273383 A1 Aug. 27, 2020

(30) Foreign Application Priority Data

Feb. 26, 2019 (CN) ..... 2019 1 0140927

(51) Int. Cl.

| | |
|---|---|
| ***G09F 13/00*** | (2006.01) |
| ***G09F 13/04*** | (2006.01) |
| ***H01R 13/62*** | (2006.01) |
| ***F21V 3/00*** | (2015.01) |
| ***F21V 23/00*** | (2015.01) |
| ***G09F 13/22*** | (2006.01) |
| ***F21V 23/06*** | (2006.01) |
| *F21Y 115/10* | (2016.01) |

(52) U.S. Cl.

CPC ..... *G09F 13/0404* (2013.01); *F21V 3/00* (2013.01); *F21V 23/001* (2013.01); *F21V 23/06* (2013.01); *G09F 13/0413* (2013.01); *G09F 13/22* (2013.01); *H01R 13/6205* (2013.01); *F21Y 2115/10* (2016.08); *G09F 2013/0418* (2013.01); *G09F 2013/222* (2013.01)

(58) Field of Classification Search

CPC ..... G09F 13/0404; G09F 13/0413; G09F 2013/0418; G09F 13/22; G09F 2013/222; F21V 23/001; F21V 3/00; F21V 23/06; H01R 13/6205; F21Y 2115/10

See application file for complete search history.

(56) References Cited

U.S. PATENT DOCUMENTS 1,192,982 A * 8/1916 Bristol et al. ..... G09F 13/0404 40/552

1,782,564 A * 11/1930 Coufal ..... G09F 13/00 40/552

(Continued)

*Primary Examiner* — Cassandra Davis

(74) *Attorney, Agent, or Firm* — McClure, Qualey & Rodack, LLP

(57) ABSTRACT

A display prop splicing device includes display bodies, luminous bodies, and connecting bodies. A first mounting site and a second mounting site are respectively formed at two ends of each connecting body. A third mounting site and a fourth mounting site are respectively formed at two ends of each display body. A first magnet and a second magnet which are attracted to each other are arranged in each first mounting site and each third mounting site, as well as in each second mounting site and each fourth mounting site. Conductive poles used for electrical connection between the adjacent display bodies are embedded into the outer edges of each first magnet and each second magnet. At least one display body is electrically connected with an external electrical control device through a power line. Multiple display bodies are conveniently and flexibly spliced through the first, second, third and fourth mounting sites.

6 Claims, 5 Drawing Sheets

(56) References Cited

U.S. PATENT DOCUMENTS

| | | | | | |
|---|---|---|---|---|---|
| 2,853,819 | A * | 9/1958 | Leesch | G09F 13/00 | 40/545 |
| 3,363,214 | A * | 1/1968 | Wright | H01R 13/6205 | 439/39 |
| 3,696,548 | A * | 10/1972 | Teller | A63H 33/042 | 446/91 |
| 4,532,579 | A * | 7/1985 | Merryman | F21V 21/005 | 362/239 |
| 5,159,772 | A * | 11/1992 | Akaley | G09F 13/26 | 40/545 |
| 7,874,844 | B1 * | 1/2011 | Fitts, Jr. | H01R 31/06 | 439/218 |
| 8,887,422 | B2 * | 11/2014 | Callahan | G09F 13/0404 | 40/551 |
| 2008/0141571 | A1 * | 6/2008 | Kottwitz | G09F 9/33 | 40/605 |
| 2016/0006187 | A1 * | 1/2016 | Kim | H01H 1/58 | 439/39 |
| 2016/0204544 | A1 * | 7/2016 | Liang | H01R 13/6205 | 439/39 |

* cited by examiner

DISPLAY PROP SPLICING DEVICE

BACKGROUND OF THE INVENTION

1. Fields of the Invention

The invention relates to the technical field of display, in particular to a display prop splicing device.

2. Descriptions of Related Art

In the prior art, an advertising word is mostly formed by a base and a luminous body erected on the base. When a plurality of luminous bodies are mounted, the design requirements of the luminous bodies can generally be met by means of the extension of bases or electrical connection of the bases through wires. However, in such implementation, due to the lack of a necessary splicing structure, disassembly and the assembly are inconvenient, the connection stability is poor, and the requirements for conveniently and flexibly mounting a plurality of luminous bodies cannot be effectively met.

SUMMARY OF THE INVENTION

The objective of the invention is to provide a display prop splicing device that is simple in structure and capable of conveniently and flexibly splicing a plurality of display bodies.

To fulfill the above objective, the technical scheme adopted by the invention is as follows:

A display prop splicing device includes display bodies, luminous bodies, and connecting bodies, wherein the luminous bodies are erected on and electrically connected with the display bodies; the connecting bodies are used for fast electrical connection between the adjacent display bodies; a first mounting site and a second mounting site are respectively formed at two ends of each connecting body; a third mounting site and a fourth mounting site are respectively formed at two ends of each display body; the first mounting sites are cooperated with the third mounting sites, and the second mounting sites are cooperated with the fourth mounting sites; when two of the display bodies are connected with each other, the third mounting site of one display body is cooperated with the fourth mounting site of the other display body; a first magnet and a second magnet which are atti acted to each other are arranged in each first mounting site and each third mounting site as well as in each second mounting site and each fourth mounting site; conductive poles used for the electrical connection between the adjacent display bodies are embedded into the outer edges of each first magnet and each second magnet; and at least one of the display bodies is electrically connected with an external electrical control device through a power line.

Wherein each display body includes a shell, a base, a positive wire and a negative wire, wherein the positive wire and the negative wire are arranged in the length-wise direction of a cavity of the shell and have two ends respectively provided with the conductive poles.

Wherein the luminous bodies are arranged on the shells and have positive poles electrically connected with the positive wires and negative poles electrically connected with the negative wires.

Wherein each luminous body includes a display shell, a circuit board, LED lamp beads, and a diffusion housing, wherein the circuit board is arranged in the display shell, the LED lamp beads are uniformly distributed on the circuit board, and the diffusion housing covers the display shell.

Wherein a first lug boss is arranged at one end of each display body; the first magnets are embedded into the intermediate parts of the first lug bosses; and the conductive poles are embedded into two opposite sides of each first magnet.

Wherein a first recess part is arranged at the other end of each display body; the second magnets are embedded into the intermediate parts of the first recess parts; and the conductive poles are embedded into two opposite sides of each second magnet.

Wherein the connecting bodies are arranged in a fan shape; a second lug boss and a second recess part are respectively arranged at two ends of each connecting body; and the first magnets are arranged in the second lug bosses, and the second magnets are arranged in the second recess parts.

Wherein the first lug bosses are inserted into the second recess parts, and the second lug bosses are inserted into the first recess parts. Wherein the first lug bosses are inserted into the first recess parts.

The invention has the following beneficial effects: the display prop splicing device provided by the invention includes the display bodies, the luminous bodies and the connecting bodies, wherein the luminous bodies are erected on and electrically connected with the display bodies; the connecting bodies are used for fast electrical connection between the adjacent display bodies; the first mounting site and the second mounting site are respectively formed at the two ends of each connecting body; the third mounting site and the fourth mounting site are respectively formed at the two ends of each display body; the first mounting sites are cooperated with the third mounting sites, and the second mounting sites are cooperated with the fourth mounting sites; when two of the display bodies are connected with each other, the third mounting site of one display body is cooperated with the fourth mounting site of the other display body; the first magnet and the second magnet which are attracted to each other are arranged in each first mounting site and each third mounting site, as well as in each second mounting site and each fourth mounting site; the conductive poles used for the electrical connection between the adjacent display bodies are embedded into the outer edges of each first magnet and each second magnet; and at least one display body is electrically connected with the external electrical control device through the power line. By adopting the display device based on the above structural design, a plurality of display bodies can be conveniently and flexibly spliced through the first mounting sites, the second mounting sites, the third mounting sites and the fourth mounting sites, so that the working efficiency is effectively improved, and the connection stability between the adjacent display bodies is improved.

DETAILED DESCRIPTION OF THE PREFERRED EMBODIMENT

Figure 1:
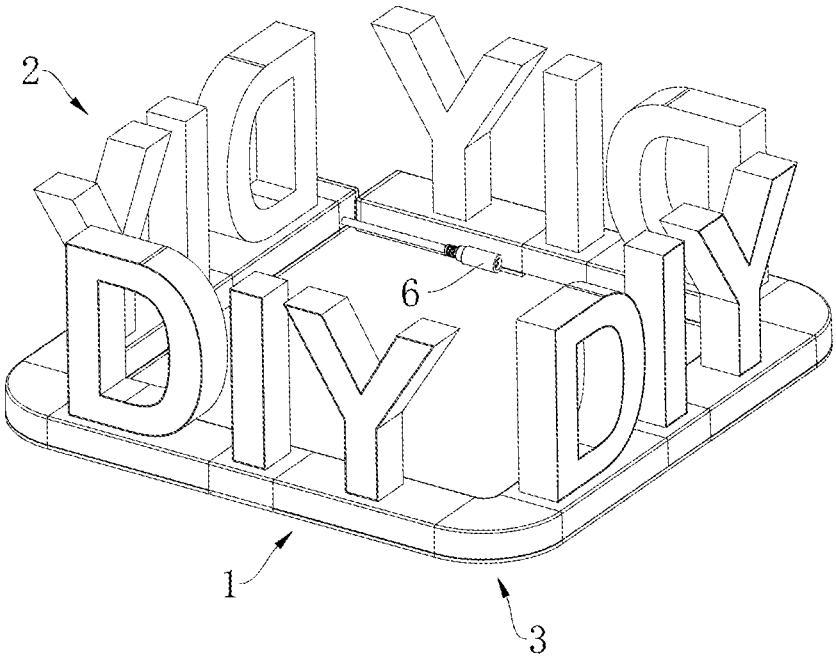
FIG. 1 is an axonometric drawing of a display prop splicing device of the invention.
Figure 2:
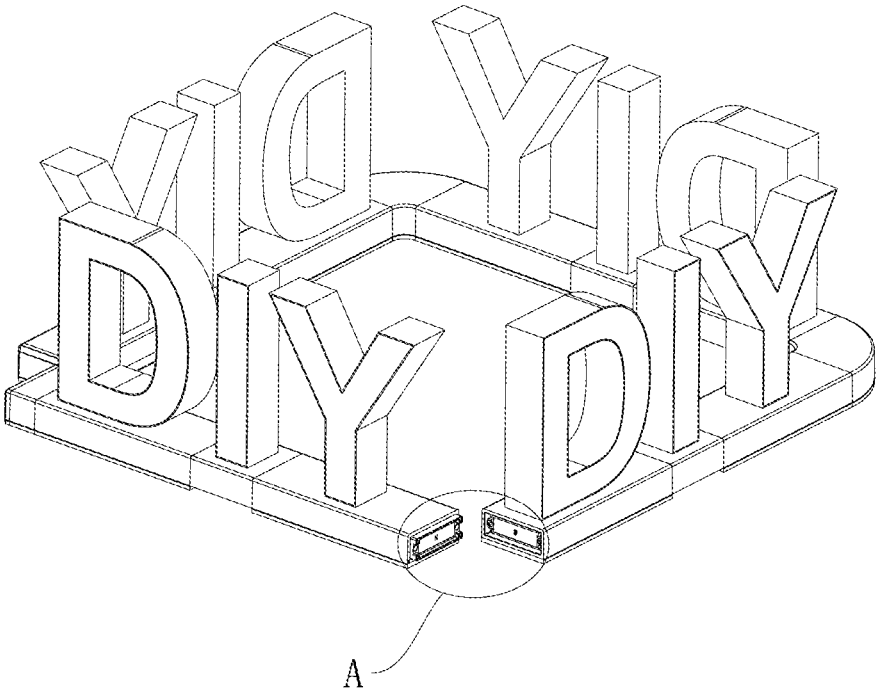
FIG. 2 is an axonometric drawing obtained by removing connecting bodies from FIG. 1.

The technical scheme of the invention is further explained as follows in combination with the drawings and specific implementations.

As shown in FIG. 1 to FIG. 5, this embodiment is provided with a display prop splicing device including display bodies 1, luminous bodies 2, and connecting bodies 3, wherein the luminous bodies 2 are erected on and electrically connected with the display bodies 1; the connecting bodies 3 are used for fast electrical connection between the adjacent display bodies 1; a first mounting site 31 and a second mounting site 32 are respectively formed at two ends of each connecting body 3; a third mounting site 11 and a fourth mounting site 12 are respectively formed at two ends of each display body 1; the first mounting sites 31 are cooperated with the third mounting sites 11, and the second mounting sites 32 are cooperated with the fourth mounting sites 12; when two of the display bodies 1 are connected with each other, the third mounting site 11 of one display body 1 is cooperated with the fourth mounting site 12 of the other display body 1; a first magnet 41 and a second magnet 42 which are attracted to each other are arranged in each first mounting site 31 and each third mounting site 11, as well as in each second mounting site 32 and each fourth mounting site 12; conductive poles 51 and 52 used for electrical connection between the adjacent display bodies 1 are embedded into the outer edges of each first magnet 41 and each second magnet 42; and at least one display body 1 is electrically connected with an external electrical control device through a power line 6.

Particularly, in this embodiment, for the sake of convenient splicing between the display bodies 1, a first lug boss 111 is arranged at one end of each display body 1; the first magnets 41 are embedded into the intermediate parts of the first lug bosses 111; and the conductive poles 51 and 52 are embedded into two opposite sides of each first magnet 41; a first recess part is arranged at the other end of each display body 1; the second magnets 42 are embedded into the intermediate parts of the first recess parts; and the conductive poles 51 and 52 are embedded into two opposite sides of each second magnet 42. A first connection method is as follows: when two adjacent display bodies 1 are to be connected into a whole, the first lug boss 111 of one display body 1 is inserted into the first recess part 121 of the other display body, and then the two adjacent display bodies are connected into a whole through strong attraction between the corresponding first magnet 41 and the corresponding second magnet 42; and after being connected, the two display bodies 1 are electrically connected through contact between the conductive poles 51 and 52 respectively arranged in the corresponding first lug boss 111 and the corresponding first recess part 121. In this way, the splicing efficiency is high, operation steps of wire soldering, screw hitting and the like are omitted, and the connection is stable and reliable.

A second connection method of this embodiment is as follows: when required to be spliced into a certain shape along a certain path, a plurality of display bodies 1 can be connected by dint of connecting parts 3. In this embodiment, a quadrangular splicing path is used as an example; the connecting bodies 3 are arranged in a fan shape; for the sake of convenient and fast splicing between each connecting body 3 and the display bodies 1 on two sides of the connecting body 3, a second lug boss 321 and a second recess part 311 are respectively arranged at two ends of each connecting body 3; and the first magnets 41 are arranged in the second lug bosses 321, and the second magnets 42 are arranged in the second recess parts 311. The same as the above connection principle, the first lug bosses 111 are inserted into the second recess parts 311, the second lug bosses 321 are inserted into the first recess parts 121, and each connecting body 3 and the display bodies 1 on two sides of the connecting body 3 are electrically connected through contact between the conductive poles 51 and 52 arranged in each first lug boss 111 and each second recess parts 311, as well as in each second lug boss 321 and each first recess part 121.

Figure 3:
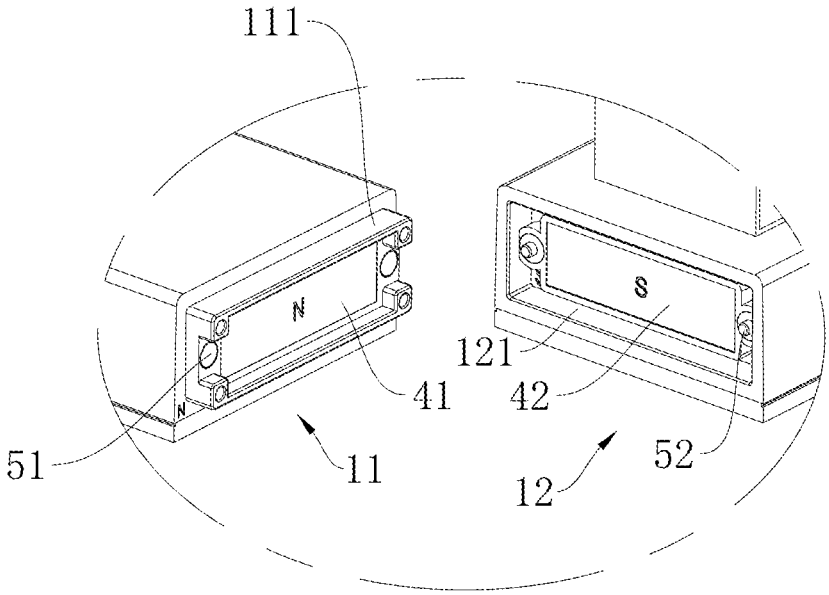
FIG. 3 is a partial enlarged view of part A in FIG. 2.
Figure 4:
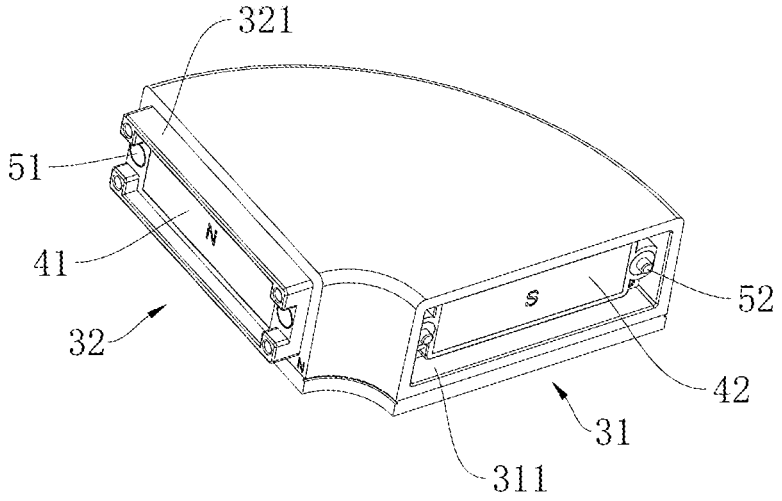
FIG. 4 is an axonometric drawing of one connecting body in FIG. 1.
Figure 5:
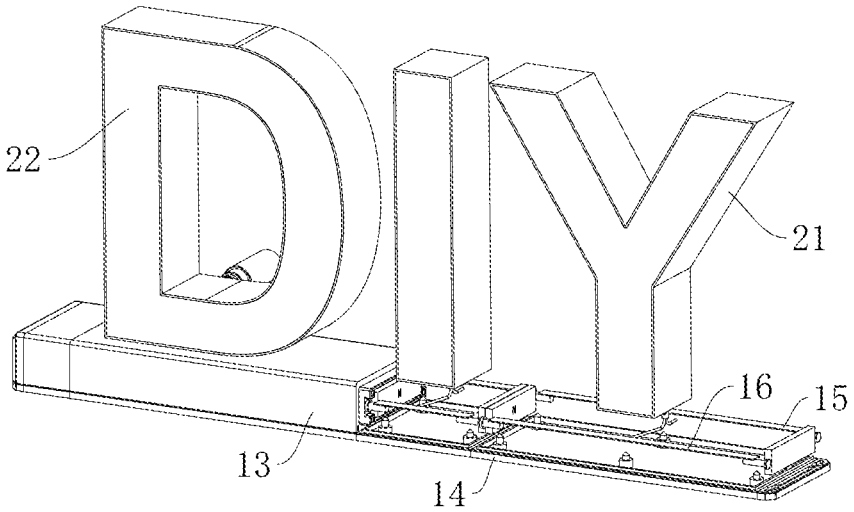
FIG. 5 is an axonometric drawing obtained by removing a part of a shell of one display body in FIG. 1.

As shown in FIG. 3 and FIG. 4, the first lug bosses 111 and the second lug bosses 321 are identical in structure and are enclosed by flanges, the corresponding first recess parts 121 and the corresponding second recess parts 311 are also identical in structure and are formed in a groove shape, and rabbets cooperated with the flanges are formed in grooves.

Further, in this embodiment, each display body 1 includes a shell 13, a base 14, a positive wire 15, and a negative wire 16, wherein the positive wire 15 and the negative wire 16 are arranged in the length-wise direction of a cavity of the shell 13 and have two ends respectively provided with the conductive poles 51 and 52; the luminous bodies 2 are arranged on the shells 13 and have positive poles electrically connected with the positive wires 15 and negative poles electrically connected with the negative wires 16; and besides, each luminous body 2 includes a display shell 21, a circuit board, LED lamp beads and a diffusion housing 22, wherein the circuit board is arranged in the display shell 21, the LED lamp beads are uniformly distributed on the circuit board, and the diffusion housing 22 covers the display shell 21. According to this structural design, for the sake of stable and reliable connection between the luminous bodies 2 and the shells 13 of the display bodies 1, the display bodies 1 and the luminous bodies 2 can be fixed in a clamping or bonding manner.

By adopting the display device based on the above structural design, the luminous bodies 2 erected on the display bodies 1 can be displayed in all directions and at different angles through fast splicing of the display bodies 1 along different paths. In this embodiment, the display shells 21 of the luminous bodies 2 can be formed as letters. Chinese characters, patterns, or the like, so that a better display effect can be fulfilled.

The technical principle of the invention is described above in combination with the specific embodiments. These descriptions are only used to explain the principle of the invention, but should not be interpreted as limitations on the protection scope of the invention in any way. On the basis of the explanation given here, those skilled in this field can associate other specific implementations of the invention without creative labor, and all these implementations should also fall within the protection scope of the invention.

What is claimed is:

1. A display prop splicing device, comprising display bodies, luminous bodies, and connecting bodies, wherein the luminous bodies are erected on and electrically connected with the display bodies;

the connecting bodies are used for fast electrical connection between the adjacent display bodies;

a first mounting site and a second mounting site are respectively formed at two ends of each said connecting body;

a third mounting site and a fourth mounting site are respectively formed at two ends of each said display body;

the first mounting sites are cooperated with the third mounting sites, and the second mounting sites are cooperated with the fourth mounting sites;

when two said display bodies are connected with each other, the third mounting site of one display body is cooperated with the fourth mounting site of the other display body;

a first magnet and a second magnet which are attracted to each other are arranged in each said first mounting site and each said third mounting site, as well as in each said second mounting site and each said fourth mounting site;

conductive poles used for the electrical connection between the adjacent display bodies are embedded into outer edges of each said first magnet and each said second magnet; and at least one said display body is electrically connected with an external electrical control device through a power line, wherein each said display body comprises a shell, a base, a positive wire, and a negative wire, wherein the positive wire and the negative wire are arranged in a length-wise direction of a cavity of the shell and have two ends respectively provided with the conductive poles, wherein the luminous bodies are arranged on the shells and have positive poles electrically connected with the positive wires and negative poles electrically connected with the negative wires, wherein each said luminous body comprises a display shell, a circuit board, LED lamp beads, and a diffusion housing, wherein the circuit board is arranged in the display shell, the LED lamp beads are uniformly distributed on the circuit board, and the diffusion housing covers the display shell.

2. A display prop splicing device, comprising:

display bodies, luminous bodies, and connecting bodies, wherein the luminous bodies are erected on and electrically connected with the display bodies;

the connecting bodies are used for fast electrical connection between the adjacent display bodies:

a first mounting site and a second mounting site are respectively formed at two ends of each said connecting body;

a third mounting site and a fourth mounting site are respectively formed at two ends of each said display body;

the first mounting sites are cooperated with the third mounting sites, and the second mounting sites are cooperated with the fourth mounting sites;

when two said display bodies are connected with each other, the third mounting site of one display body is cooperated with the fourth mounting site of the other display body;

a first magnet and a second magnet which are attracted to each other are arranged in each said first mounting site and each said third mounting site, as well as in each said second mounting site and each said fourth mounting site;

conductive poles used for the electrical connection between the adjacent display bodies are embedded into outer edges of each said first magnet and each said second magnet; and at least one said display body is electrically connected with an external electrical control device through a power line, wherein a first lug boss is arranged at one end of each said display body; the first magnets are embedded into intermediate parts of the first lug bosses; and the conductive poles are embedded into two opposite sides of each said first magnet.

3. The display prop splicing device according to claim 2, wherein a first recess part is arranged at one end of each said display body; the second magnets are embedded into intermediate parts of the first recess parts; and the conductive poles are embedded into two opposite sides of each said second magnet.

4. The display prop splicing device according to claim 3, wherein the connecting bodies are arranged in a fan shape; a second lug boss and a second recess part are respectively arranged at two ends of each said connecting body; and the first magnets are arranged in the second lug bosses, and the second magnets are arranged in the second recess parts.

5. The display prop splicing device according to claim 4, wherein the first lug bosses are inserted into the second recess parts, and the second lug bosses are inserted into the first recess parts.

6. The display prop splicing device according to claim 3, wherein the first lug bosses are inserted into the first recess parts.

* * * * *